United States Patent [19]

Shand

[11] 4,027,462

[45] June 7, 1977

[54] APPARATUS AND METHOD FOR INCREASING SPEED OF HORSES

[76] Inventor: Kenneth James Shand, 418 N. Union St., Wilmington, Del. 19805

[22] Filed: Oct. 29, 1975

[21] Appl. No.: 626,768

[30] Foreign Application Priority Data

Oct. 30, 1974 Australia ..... 9421/74
May 19, 1975 Australia ..... 81314/75

[52] U.S. Cl. ..... 54/71; 54/72
[51] Int. Cl.[2] ..... B68B 1/00
[58] Field of Search ..... 54/71, 72, 2; 119/126, 119/128, 29, 96

[56] References Cited

UNITED STATES PATENTS

| | | | |
|---|---|---|---|
| 438,360 | 10/1890 | Phelps | 54/72 |
| 444,570 | 1/1891 | Phelps | 54/72 |
| 466,109 | 12/1891 | Whitaker | 54/72 |
| 510,337 | 12/1893 | Glascork | 54/72 |
| 545,413 | 8/1895 | Passmore | 54/72 |

FOREIGN PATENTS OR APPLICATIONS

| | | | |
|---|---|---|---|
| 237,738 | 8/1960 | Australia | 119/126 |

*Primary Examiner*—Louis G. Mancene
*Assistant Examiner*—Peter K. Skiff

[57] ABSTRACT

A method and apparatus for preventing knee-knock in quadruped animals such as horses comprising positioning a loop around the forelegs of the animal and urging the loop upwardly to cause the unweighted foreleg to move transversely outwardly whereby knee-knock is prevented and said animal is able to trot or pace at a higher rate of speed with a greater degree of comfort.

7 Claims, 3 Drawing Figures

APPARATUS AND METHOD FOR INCREASING SPEED OF HORSES

RELATIONSHIP TO PRIOR FILED APPLICATION

Applicant claims convention priority from his Australian provisional specification filed Oct. 30, 1974 as Australian Pat. No. PB9421, and Australian Pat. No. 81314/75, filed May 19, 1975.

BACKGROUND OF INVENTION

This invention relates to a leg spreader for guadruped animals and relates particularly, but not exclusively, to an improved leg spreader for trotting and/or pacing horses which lessens the likelihood of knee-knock.

Knee-knock occurs in trotting and/or pacing horses when the unweighted leg of the horse is lifted upwardly and forwardly and as the hoof of that leg is moved past the knee of the weighted leg. During such movement the hoof knocks the knee of the weighted leg.

SUMMARY OF THE INVENTION

According to the present invention there is provided a leg spreader for use with guadruped animals to cause unweighted forelegs to which it is associated to be urged transversely outwardly of the animal to thereby attempt to prevent knee-knock, said spreader comprising a loop for positioning around the upper inside portion of the foreleg and spring biasing means being in the loop and/or ancilliary to the loop but connected thereto and anchorable to either the animal or members carried by the animal to, in use, bias the loop and cause leg spreading as aforesaid.

Most peferably the animal is a horse and the loop includes a soft rubber portion for resisting chaffing of the horse's leg portion or xiphoid region where it contacts the horse.

The apparatus of this invention is also defined as a leg spreader for use with quadruped animals having forelegs and a xiphoid region to cause the unweighted foreleg of the animal while trotting or pacing, with which it is associated, to be urged transversely outwardly of the animal to prevent knee-knock, said spreader comprising a loop adapted to be positioned around the upper inside portion of the foreleg and biasing means operatively associated with the loop that are adapted to be attached to an anchoring means carried by the animal to, in use, bias the loop, to urge the loop upperwardly to provide leg spreading to prevent knee-knock.

The process of this invention is described as a method for use with quadruped animals having four legs and a xiphoid region to prevent knee-knock while trotting or pacing, said process comprising: (a) positioning a loop shaped member around the upper inside portion of each foreleg of the animal and (b) urging the loop upwardly by biasing the loop with a biasing means that are anchored to parts carried by the animal to urge the unweighted forelegs of the animal transversely outwardly of said animal whereby knee-knock is prevented and said animal is capable of achieving higher speeds with a greater degree of comfort.

DETAILED DESCRIPTION OF THE INVENTION

In order that the present invention can be more clearly ascertained a preferred construction of a leg spreader will now be described with reference to the accompanying drawings.

Figure 1:
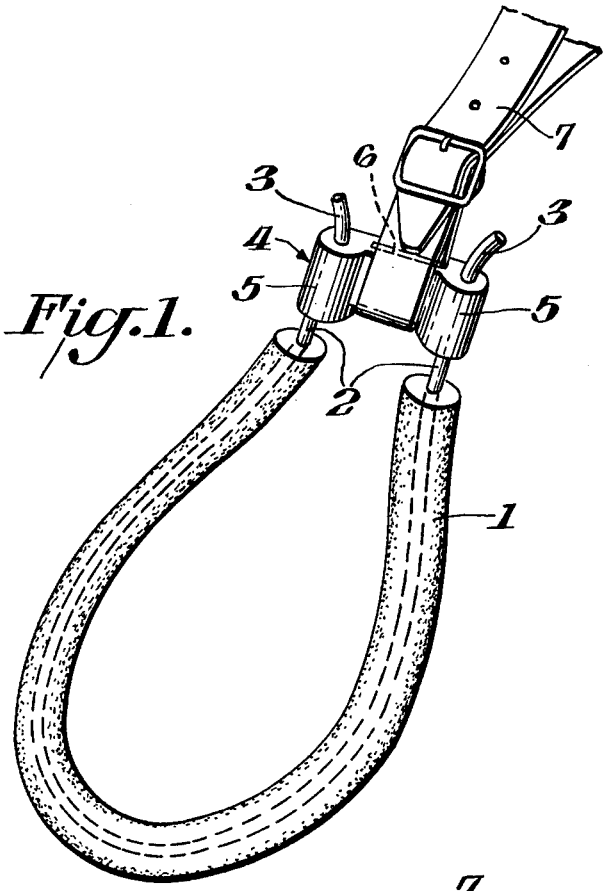
FIG. 1 is a plain elevational view of the apparatus of this invention.
Figure 2:
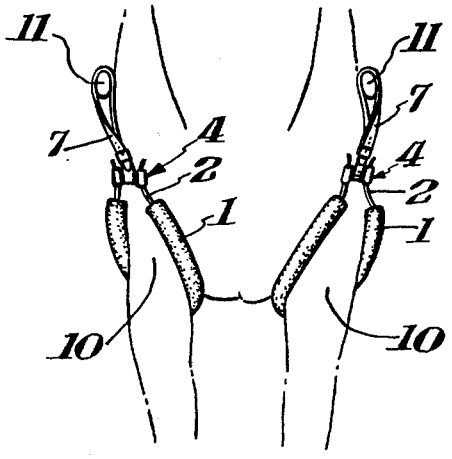
FIG. 2 is a front, pictorial view of the apparatus of this invention positioned about the forelegs of a horse.

The leg spreader has a loop portion 1, made of a soft rubber material such as synthetic foam of 4 cm. in diameter and of 60 cm. in length. The loop 1 has a 1½ cm. diameter bore extending therethrough and fitted within that bore is a gum rubber sling 2 which has a circular cross-section, the diameter of which is approximately the same as that of the bore of the loop 1. The unextended length of the sling 2 is the same as that of the loop 1 except that it has further end portions 3 which pass through a yoke member 4. The yoke member 4 clamps the gum rubber sling portion 3 in clamping portions 5. The yoke has a slot 6 which extends between the clamping portions 5 which, in turn, receives an adjustable strap 7. The strap 7 is arranged for anchoring to a sulky frame 11 which passes longitudinally down each side of the horse. The strap 7 is adjusted so that the sling 2 is stretched somewhat as shown in FIG. 2. Such stretching provides spring biasing forces to the loop 1 which when fitted to the horse's forelegs 9, as shown in FIG. 2, urges the leg 9 outwardly when it is unweighted.

Figure 3:
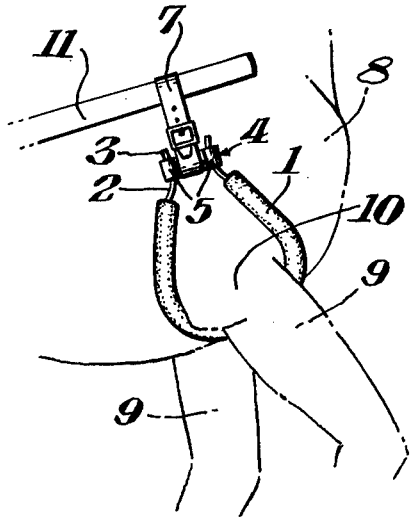
FIG. 3 is a side, pictorial view of the apparatus of this invention positioned on the forelegs of a horse.

In use, a spreader is fitted to each of the forelegs of the horse and most preferably each spreader is arranged to pass between the elbow and the xiphoid region 10 of the horse as shown in FIG. 3.

It will be appreciated that the invention can be realized with many forms of spring biasing means. For example, instead of providing a spring biasing loop 3 the loop 3 may be made substantially non spring biasing and the strap 7 may include spring biasing means such as springs or rubber portions.

It will also be realized that instead of the anchoring being on the sulky, such anchoring may be on the saddle or neck or some other part of the horse carrying the appropriate harness. Further, the two leg spreaders may be anchored by strapping or other like connection means which pass over the top of the horse and interconnect the anchor means.

I claim:

1. A leg spreader for spreading forelegs of a quadruped animal having a xiphoid region, to cause the unweighted forelegs of the animal while trotting or pacing, with which it is associated, to move transversely outwardly of the animal to prevent knee knock, said spreader comprising for each foreleg, in combination:

a. anchoring means carried by the animal operatively mounted above the forelegs of the animal, b. a resilient loop member having an upper end portion adapted to be arranged and disposed outboard and closely adjacent the animal, said loop member being positioned around the upper inside portion of the foreleg, and c. vertical urging biasing means located within the loop member operatively associated with the end portion of the loop member and the anchoring means to bias the loop member to urge the loop member upwardly to provide leg spreading to prevent knee knock, said loop member having a sufficient size and bulk to cause the unweighted forelegs of said animal to swing over and outwardly of said loop member when moving rearwardly to provide leg spreading and decrease knee knocking.

2. A leg spreader as claimed in claim 1 wherein the resilient loop member includes a soft cover for resisting chaffing of the animal.

3. A leg spreader as claimed in claim 1 wherein the loop member is of a size to fit about the upper inside foreleg of a horse around the xiphoid region.

4. A leg spreader as claimed in claim 1 wherein the loop member and biasing means comprises a gum rubber inner sling having a soft cover.

5. A leg spreader as claimed in claim 1 wherein the end portion of the loop member terminates with a yoke attached to normally upperwardly extending loop ends and the yoke has a strap member connected thereto which is fastenable to the anchoring means to, in use, bias the loop upperwardly.

6. A leg spreader as in claim 5 wherein the strap is adapted to fit onto a sulky frame of a pacing or trotting horse, and the sulky frame is the anchoring means carried by the animal.

7. A method for use with quadruped animals having forelegs and a xiphoid region to prevent knee-knock while trotting or pacing, said process comprising:

a. positioning a resilient loop shaped member around the upper inside portion of each foreleg of the animal, said loop shaped member having an end portion arranged upwardly and disposed outwardly of and closely adjacent the animal, and b. vertically urging the loop shaped member upwardly by biasing the loop member with biasing means located within the loop member operatively associated with and anchored to parts carried by the animal above each foreleg and further associated with the end portion of the loop member, said loop member being of sufficient size and bulk to cause said unweighted forelegs of the animal to swing over and outwardly of said loop as the foreleg is moving rearwardly, whereby knee-knock is prevented and said animal is capable of achieving higher speeds with a greater degree of comfort.

* * * * *